US006671916B2

(12) United States Patent
Herr et al.

(10) Patent No.: US 6,671,916 B2
(45) Date of Patent: Jan. 6, 2004

(54) LAUNDRY APPLIANCE HAVING AUTOMATIC START FEATURE

(75) Inventors: Nedra A. Herr, Newton, IA (US); Kimberly J. Hood, Mitchellville, IA (US); Michael D. Lafrenz, Newton, IA (US); Brian L. Ness, Newton, IA (US); Brett C. Oleson, Newton, IA (US)

(73) Assignee: Maytag Corporation, Newton, IA (US)

( * ) Notice: Subject to any disclaimer, the term of this patent is extended or adjusted under 35 U.S.C. 154(b) by 293 days.

(21) Appl. No.: 09/919,793

(22) Filed: Aug. 2, 2001

(65) Prior Publication Data

US 2003/0024057 A1 Feb. 6, 2003

(51) Int. Cl.[7] ..... D06F 33/00
(52) U.S. Cl. ..... 8/159; 68/12.27
(58) Field of Search ..... 8/158, 159; 68/12.12, 68/12.27

(56) References Cited

U.S. PATENT DOCUMENTS

| | | | | |
|---|---|---|---|---|
| 4,763,425 A | | 8/1988 | Grennan | 34/48 |
| 4,955,213 A | | 9/1990 | Ohsugi et al. | 68/12 R |
| 5,072,473 A | | 12/1991 | Thuruta et al. | 8/159 |
| 5,279,134 A | * | 1/1994 | Nonogaki et al. | 68/12.27 |
| 5,293,760 A | | 3/1994 | Tani et al. | 68/12.02 |
| 5,297,307 A | | 3/1994 | Baek | 8/159 |
| 5,644,936 A | | 7/1997 | Yasutake et al. | 68/12.02 |
| 5,694,793 A | | 12/1997 | Nishimura et al. | 68/12.27 |
| 6,502,265 B2 | * | 1/2003 | Blair et al. | 8/159 |
| 2002/0116959 A1 | * | 8/2002 | Ohta et al. | 68/12.27 |

FOREIGN PATENT DOCUMENTS

| | | |
|---|---|---|
| GB | 2199676 | 7/1988 |
| JP | 1-223996 | 9/1989 |

* cited by examiner

*Primary Examiner*—Randy Gulakowski
*Assistant Examiner*—Joseph L Perrin
(74) *Attorney, Agent, or Firm*—Diederiks & Whitelaw, PLC

(57) ABSTRACT

A laundry appliance can be selectively operated in either manual or automatic modes of operation. In the automatic mode, a laundering operation is initiated upon receiving a single cycle input parameter from the user, preferably through a LCD touch screen display, while relying on additional operating cycle parameters established by factory preset settings or prior consumer established preferences. In accordance with a preferred embodiment of the invention, a consumer need merely select a single cycle parameter and the appliance will start based on temperature and other setting parameters taken from memory. However, even with the automatic start feature activated, the user will still be able to adjust pre-established cycle parameters by changing default values after the cycle has started.

14 Claims, 4 Drawing Sheets

LAUNDRY APPLIANCE HAVING AUTOMATIC START FEATURE

BACKGROUND OF THE INVENTION

1. Field of the Invention

The present invention pertains to the art of appliances and, more particularly, to a laundry appliance which can be selectively operated in an automatic mode wherein a laundering cycle is initiated with minimum input from a user, while subsequent cycle modifications can still be made.

2. Discussion of the Prior Art

In order to operate a laundry appliance, i.e., either a clothes washer or dryer, it is necessary for a user to initially select various cycle parameters. For instance, in order to establish a desired washing operation in a clothes washing machine, typically required selections include the water level, water temperature, type of fabric and cycle duration. In most clothes washers, buttons and/or rotatable dials are employed for these programming purposes.

In many instances, a particular user of a washing machine will establish common operating parameters between successive cycles for the same type of fabrics. For example, it would not be uncommon for a user to almost consistently select large water level, hot wash/warm rinse and heavy soil wash time settings when washing white cotton clothing items. However, these settings will almost invariably be altered before a washing operation of the same type of garments is performed. In other words, the washing of whites will typically be followed by the washing of colors or dark clothing which will require the settings to be altered. Therefore, it is not uncommon for the user to need to customize nearly every available parameter setting for each washing operation performed, even though the settings used for the same type of fabrics tend to be consistent.

Certainly, the need to change the various operating parameters for each washing operation represents some level of inefficiency. To address this problem, it has been proposed to automate an overall washing operation. Examples of known automatic washing machine arrangements are represented by the disclosures in U.S. Pat. Nos. 5,072,473, 5,297,307, 5,293,760 and 5,694,793, each of which provides for a fully automatic operating mode wherein a washing operation can be performed with minimum required input. For instance, in accordance with U.S. Pat. No. 5,072,473, a cycle can be started for washing an object placed in a drum of a washing machine upon selecting one of "heavily soiled", "standard" and "lightly soiled" modes, along with any desired pre-washing operations. The '307 patent is directed to a washing machine including both manual and automatic washing features. Upon the selection of the automatic washing feature, the appliance analyzes a series of stored washing factors accumulated from the operation of the machine in a manual mode and, through a self-learning sequence, determines final washing factors to be implemented during the automatic operation. In accordance with U.S. Pat. No. 5,293,760, a washing operation can be initiated by a consumer upon the selection of only a start button. Finally, in the '793 patented arrangement, an automatic washing cycle will be commenced following receipt of inputs concerning the type of washing cycle to be performed. In any event, the purpose of these types of arrangements is to minimize the required number of inputs by the user to perform a washing operation.

To perform these automatic functions, sensors are commonly employed to specifically detect certain parameters which would otherwise need to be inputted by the user. For example, the washer disclosed in the '473 patent utilizes at least a cloth amount sensor to detect a quantity of an object being washed. In a somewhat corresponding manner, the '760 patented arrangement detects, among other factors, a washing quantity, cloth characteristics and entanglement characteristics of the wash load. In any event, although these prior art arrangements advantageously enable a washing operation to be performed with a minimum number of inputs, employing complicated sensor structure to compensate for the lack of user inputs is seen to represent a costly alternative. In addition, these arrangements are seen to be disadvantageous in that, after a particular washing cycle has been initiated, the user is reframed from altering the overall cycle parameters.

Based on at least these reasons, there exists a need in the art for a cost effective and efficient control system for a laundry appliance which will enable an entire cycle to be performed with a minimum amount of input on the part of the user. More particularly, there exists a need in the art for a laundry appliance which can be programmed, either during manufacture or by a user, to perform common cycles with minimum input by the user, while still enabling the cycles to be altered after initiation thereof.

SUMMARY OF THE INVENTION

The present invention is directed to establishing an automatic start feature in a laundry appliance whereby a laundering operation can be initiated with minimum input by the user. More specifically, the laundry appliance can store typical operating cycles for different types of fabrics, either based on factory settings or consumer established preferences, in order to enable the appliance to start immediately following a selection of a single cycle parameter. In accordance with a preferred embodiment of the invention, a consumer need merely select a particular fabric type and the appliance will start based on temperature and other setting parameters taken from memory. However, even with the automatic start feature activated, the user will still be able to adjust pre-established cycle parameters by changing default values after the cycle has started.

In accordance with the invention, the "auto start" feature can be selectively turned either OFF or ON. Therefore, the laundry appliance can be selectively operated in either manual or automatic modes. If the OFF mode is selected, the user will be required to input all necessary information to initiate a desired cycle. In the ON mode, factory settings, as modified based on consumer preferences either before or after initiating a particular washing operation, will be employed. In its most preferred form, the invention is incorporated in a clothes washing machine and, more particularly, a washing machine incorporating an LCD touch screen display.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
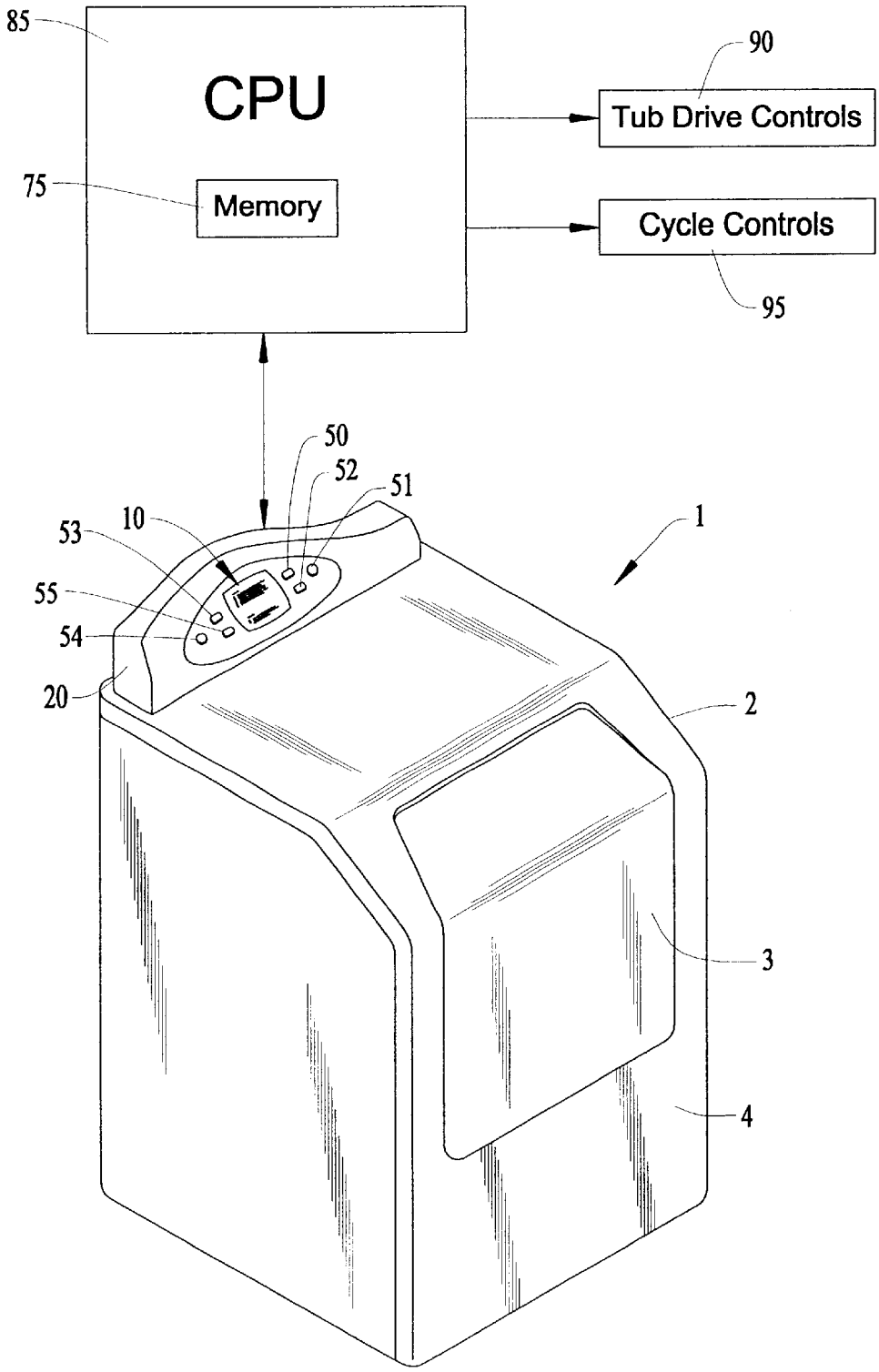
FIG. 1 is a perspective view of a clothes washing machine incorporating a touch screen display and the auto-start feature of the invention.

With initial reference to FIG. 1, a laundry appliance 1 is schematically shown in the form of a washing machine. Appliance 1 includes a cabinet 2 provided with a door 3 in a front face 4. Door 3 is designed to be pivoted to expose an integral washing tub (not shown). A display 10 is integrated into a control panel 20 through which a user can control and program washing appliance 1 as will be detailed below. Appliance 1 also includes various control buttons 50–56 shown about display 10.

In accordance with a preferred embodiment of the invention, an "OFF" button 50 is provided to selectively turn off or reset laundry appliance 1. Button 51 constitutes a "START/PAUSE" button used to initiate or pause a selected washing operation. A "HELP" button 52 is provided to enter a help control mode as will be discussed further below. A "HOME" button 53 is used to enter another control mode which will also be discussed fully below. Button 54 enables direct access to "FAVORITES" relating to preferred cycle parameters stored by a user in a memory 75 of a CPU 85 used to regulate tub drive controls, generally indicated at 90, and cycle controls 95. Finally, a "BACK" button 55 is provided to erase an inadvertently inputted control parameter or revert back to a prior screen on display 10. As will also become more fully evident below, the particular control configuration for laundry appliance 1 can significantly vary in accordance with the present invention.

The present invention is directed to the selective use of laundry appliance 1 in either manual or automatic modes of operation. Although the input of cycle parameters for a desired washing operation can be accomplished in many different ways in accordance with the present invention, in the preferred embodiment, the input of cycle parameters is performed through display 10. That is, in the most preferred form of the invention, display 10 takes the form of an LCD touch screen, such as a 128×96 dot matrix, touch screen display, which enables a user to readily review displayed data, preferably in alpha or word text format, and select from that data to establish and begin a desired washing operation, as well as retrieve a wide range of information regarding appliance 1.

Figure 2A:
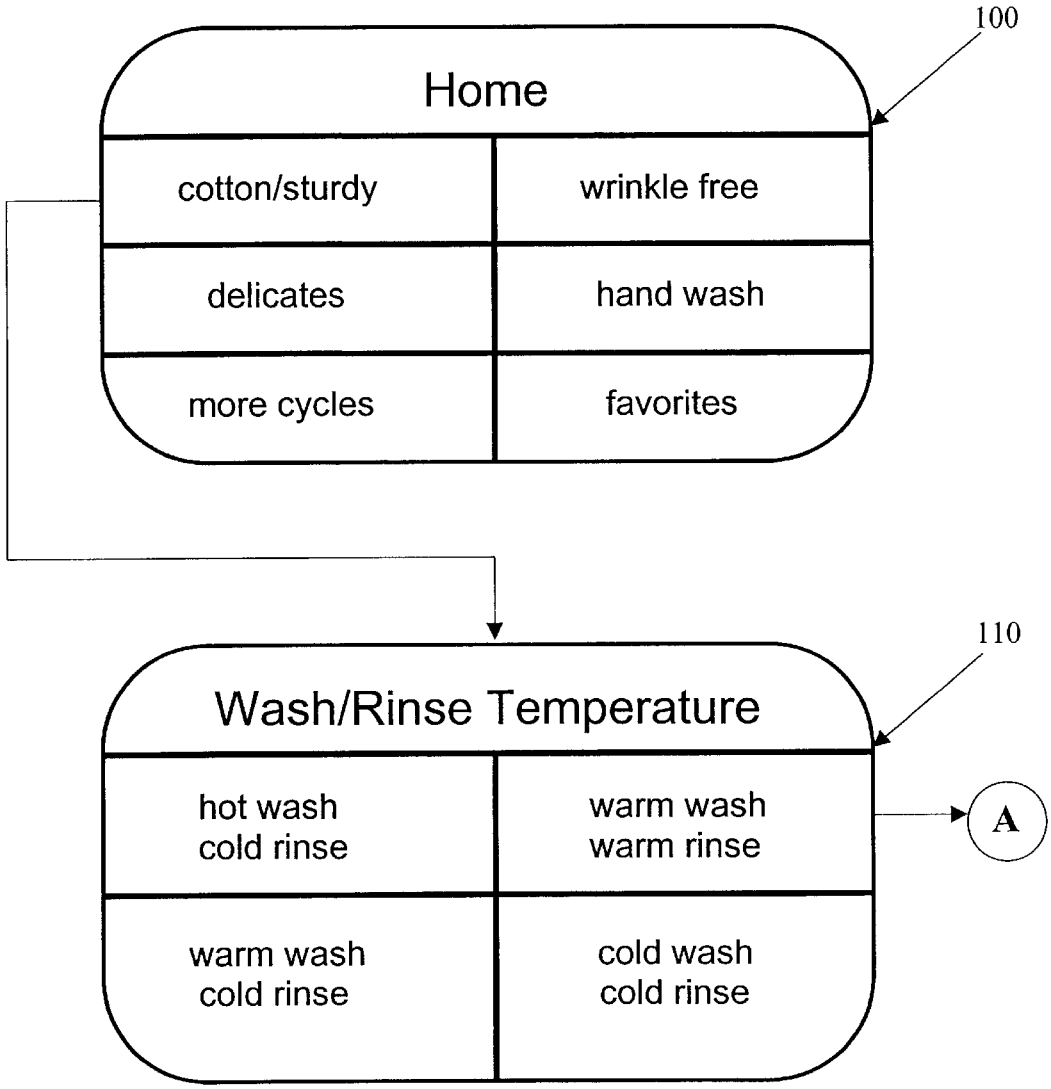
FIG. 2A is a diagrammatic representation of a portion of an operating screen sequence employed in accordance with a preferred embodiment of the invention.
Figure 2B:
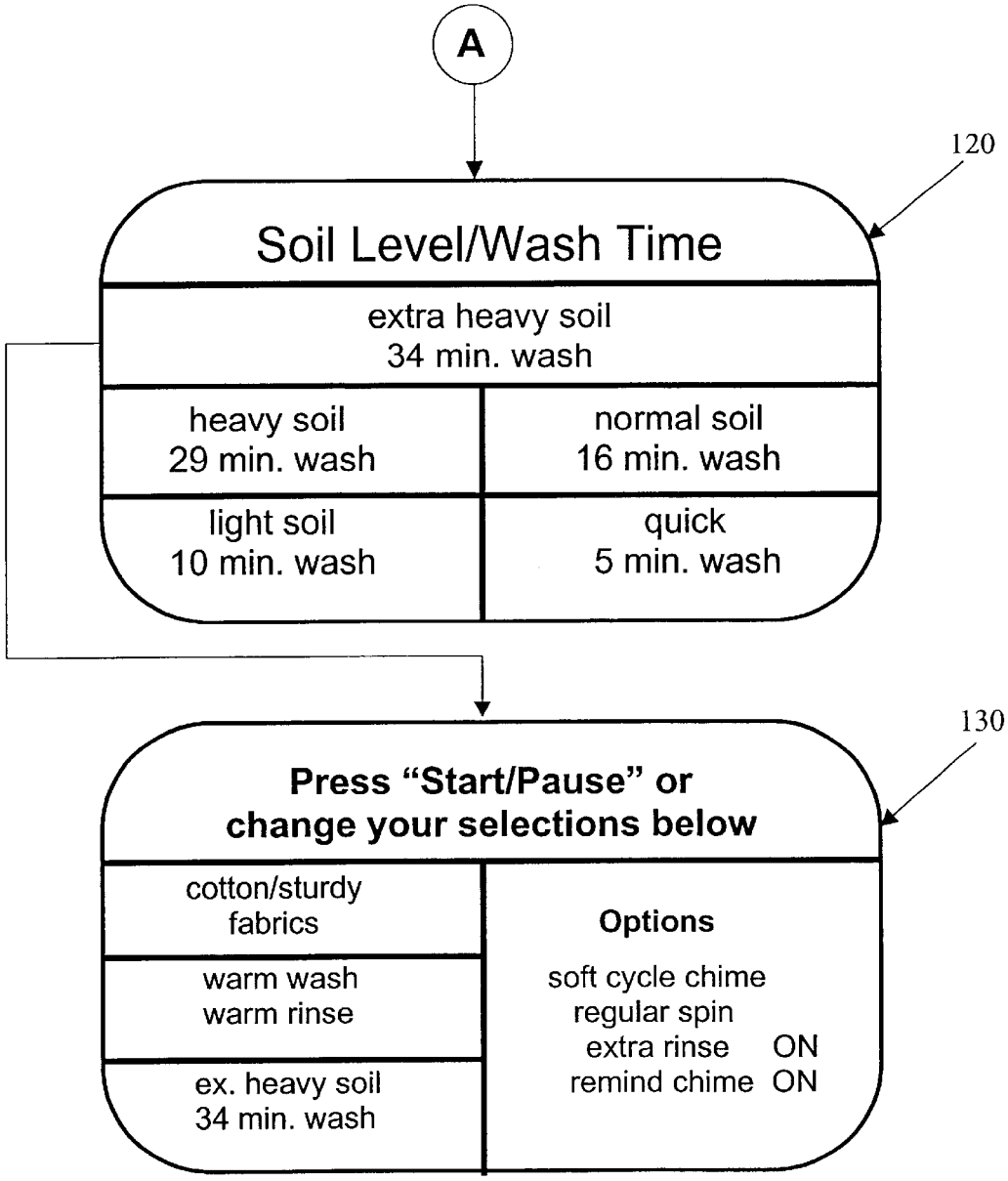
FIG. 2B is a diagrammatic representation of additional operating screens in the overall sequence of FIG. 2A.

In any event, FIGS. 2A and 2B depict a preferred programming sequence used to illustrate the manner in which potential cycle inputs are presented to a user for selection in a manual mode of operation for laundry appliance 1. In general, in the manual mode of operation, the user is required to input at least the particular fabric type, wash/rinse temperature and soil level/wash time before initiating a washing operation. To this end, screen 100 is initially presented to the user on display 10 upon pressing "HOME" button 53. As shown, screen 100 preferably presents various fabric type options for laundry appliance 1. With screen 100 displayed, the user can select a desired cycle input by simply touching the corresponding portion of display 10. As shown, the user is provided with the option of selecting between "cotton/sturdy", "wrinkle free", "delicates" or "hand wash" fabric types.

On the other hand, the user could select "more cycles" for other potential wash and/or special rinse cycles. The "favorites" option is preferably provided in connection with enabling a user to store desired cycle parameters relating to specific loads which are continuously washed. For example, the user of laundry appliance 1 may have uniforms or grass-stained clothing that need to be periodically washed utilizing a consistent set of wash cycle parameters. Therefore, instead of requiring the user to re-input the overall set of wash cycle parameters each time, these "favorites" can be stored in memory 75 of CPU 85 for easy access. Since the programming of laundry appliance 1 in this manner is not considered part of the present invention, it will not be discussed further herein.

In the example provided, the user has selected the "cotton/sturdy" fabric type through screen 100. This selection causes display 10 to automatically convert to screen 110 in order to enable the user to input a desired wash/rinse temperature. As shown, the user preferably can select between "hot wash/cold rinse", "warm wash/warm rinse", "warm wash/cold rinse" and "cold wash/cold rinse" options. For exemplary purposes, the "warm wash/warm rinse" option has been selected which causes screen 120 as shown in FIG. 2B to be presented on display 10. Screen 120 enables the final, required cycle parameter, i.e., the soil level/wash time, to be selected. Again, although shown just with respect to a preferred embodiment of the invention, the user has the option of selecting between "extra heavy soil—34 min. wash", "heavy soil—29 min. wash", "normal soil—16 min. wash", "light soil—10 min. wash" and "quick—5 min. wash". As shown, the "extra heavy soil—34 min. wash" option has been selected, thereby resulting in the presentation of screen 130 in display 10. As shown by screen 130, it is desired in accordance with the invention to provide the user with a summary of selected cycle parameters, as well as a list of further options which could be established by the user based on personal preferences. If the collective cycle parameters are approved by the user, the depression of "START/PAUSE" button 51 will initiate the laundering operation. If changes are desired, the particular selected parameter can be highlighted through screen 130 or "BACK" button 55 can be used to revert back to prior selection screens.

Figure 3:
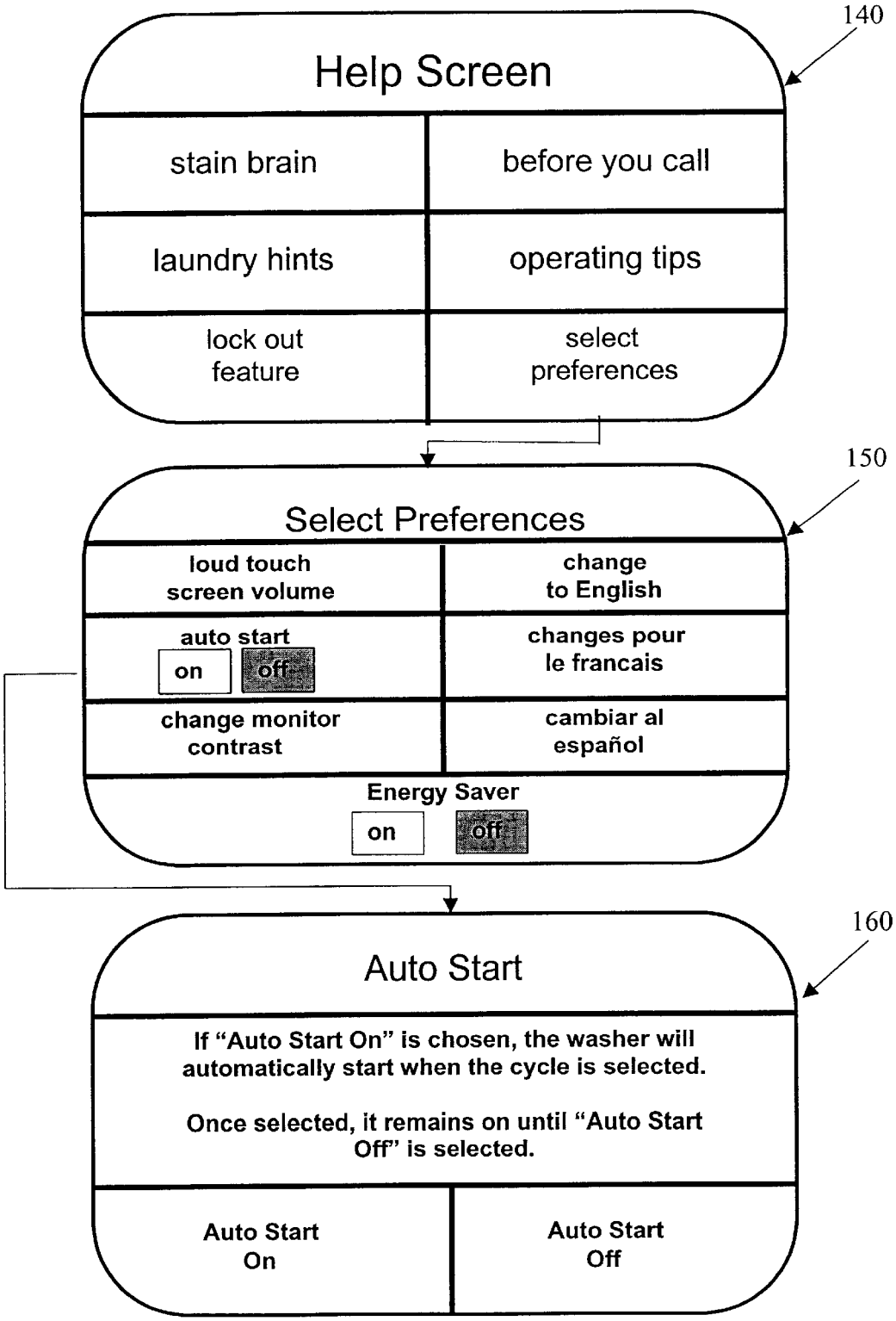
FIG. 3 is a diagrammatic representation of another operating screen sequence employed in accordance with the invention.

Again, the manual input sequence described above is employed when the user does not activate the automatic washing mode. Preferably, laundry appliance 1 is set with the automatic mode defaulted to OFF. However, the user has the option of switching laundry appliance 1 to the automatic mode. By depressing "HELP" button 52, the user will be presented with screen 140 as shown in FIG. 3. For purposes of the present invention, although various help selections are available, it is assumed that the user has chosen "Select Preferences", thereby resulting in screen 150 in display 10. As shown, screen 150 can be utilized to alter the volume, language, monitor contrast and energy related features which are preferably incorporated into laundry appliance 1 but not encompassed by the present invention. More importantly, screen 150 includes an "auto start" preference selection. In the preferred embodiment, the auto start feature can be toggled between ON/OFF states. Screen 150 shows the auto start feature in the OFF position. However, upon selecting the auto start feature in screen 150, screen 160 will be presented. Screen 160 preferably provides the user with a brief instruction concerning the auto start feature and enables the user to toggle between the ON/OFF states.

If the "Auto Start On" feature is selected, the user is only required to input a minimum number of desired cycle parameters in order to initiate a laundering operation. For instance, in the automatic mode of operation, when the user arrives at screen 100 and selects the "cotton/sturdy" fabric type, laundry appliance 1 will automatically initiate a washing operation. Therefore, in accordance with the most preferred form of the invention, a minimum of one cycle input parameter needs to be selected by the user. The remaining, necessary cycle input parameters will be taken from default values stored in memory 75. In accordance with a first embodiment of the invention, these default values are factory preset. In accordance with another embodiment, the cycle parameter selections made by the user during a previous laundering operation in the manual mode, in which the same fabric type was selected, are employed. In either case, the time required for the user to program laundry appliance 1 and initiate the laundering operation is greatly reduced versus the manual mode of operation.

Although the need to select more than one required cycle parameter while in the automatic mode of operation is avoided, the present invention specifically enables the user to still alter the default parameters following initiation of the laundering operation. Therefore, although the laundering operation will be automatically started upon pressing "cotton/sturdy" in screen 100 in accordance with the example provided, the user is still able to adjust the wash/rinse temperature, soil level/wash time and/or any of the remaining option selections while laundry appliance 1 is running. This determination by the user can be easily made, particularly with the user still being provided with a summary of the various settings in display 10. Of course, if all of the settings are satisfactory, no further input by the user is required.

Based on the above, it should be readily apparent that the present invention advantageously provides for a laundry appliance 1 which can be selectively operated in differing modes. If the user tends to frequently run the same type of cycle, the automatic mode of operation is considered to be particularly advantageous. However, it is important to note that the most preferred embodiments of the present invention do not employ expensive sensor arrangements to determine or calculate necessary cycle input parameters such that an efficient, yet cost effective arrangement is provided. In addition, it is considered a particularly advantageous feature of the invention to enable cycle parameters to still be altered by the user after a laundering operation is already initiated in the automatic mode of operation.

Although described with reference to preferred embodiments of the invention, it should be readily understood that various changes and/or modifications can be made to the invention without departing from the spirit thereof. For instance, although the invention has been described in detail with reference to a clothes washing machine, the invention can also be readily employed in a clothes dryer. In addition, although the fabric type is a preferred setting selection received from the user in accordance with the invention, it should be realized that the actual cycle parameter that needs to be inputted by the user in order to initiate the laundering operation in the automatic mode could be varied. In general, the invention is only intended to be limited by the scope of the following claims.

We claim:

1. A method of performing a washing operation in a laundry appliance capable of manual and automatic modes of operation comprising:

selecting the automatic mode of operation; and initiating a laundering operation based on an input parameter from a user and additional, default parameters pre-programmed in the laundry appliance, while enabling at least one of the plurality of default parameters to be altered by the user following initiation of the laundering operation.

2. The method of claim 1, further comprising: selecting a fabric type as the input parameter from the user in the automatic mode.

3. The method of claim 1, further comprising: operating in the automatic mode with the default parameters being based on factory settings stored in the laundry appliance.

4. The method of claim 1, further comprising: operating in the automatic mode with the default parameters being pre-programmed in the laundry appliance by the user.

5. The method of claim 4, wherein the default parameters are pre-programmed by the user based on a prior laundering operation.

6. The method of claim 1, further comprising: displaying at least one of the input parameters for selection by the user on a screen integrated into the laundry appliance.

7. The method of claim 6, further comprising: selecting the plurality of input parameters through the screen.

8. A laundry appliance comprising:

means for inputting one or more desired cycle parameters for a laundering operation;

means for selectively operating the laundry appliance in one of a manual mode, wherein the laundering operation is performed based on and following receipt of a plurality of cycle parameters selected by a user through the inputting means, and an automatic mode, wherein the laundering operation is performed based on a cycle parameter from a user in combination with additional, default parameters pre-programmed in the laundry appliance; and means for manually altering at least one of the plurality of default parameters following initiation of the laundering operation in the automatic mode.

9. The laundry appliance according to claim 8, wherein the laundry appliance has the default parameters factory pre-installed.

10. The laundry appliance according to claim 8, further comprising: means for pre-programming the default parameters in the laundry appliance by the user.

11. The laundry appliance according to claim 10, wherein the pre-programming means establishes the default parameters based on cycle parameters selected by a user in a prior laundry operation.

12. The laundry appliance according to claim 8, further comprising: a screen integrated into the laundry appliance for displaying at least one cycle parameter selected by the user.

13. The laundry appliance according to claim 12, wherein the screen comprises an LCD touch screen for entering the plurality of cycle parameters.

14. The laundry appliance according to claim 8, further comprising: a screen integrated into the laundry appliance for displaying a summary of the plurality of cycle parameters selected by the user in the manual mode for review and approval by the user prior to performing the laundry operation.

* * * * *